US012168985B1

(12) United States Patent
Amalric

(10) Patent No.: US 12,168,985 B1
(45) Date of Patent: Dec. 17, 2024

(54) CENTRIFUGAL PUMP FOR CONVEYING A FLUID

(71) Applicant: Sulzer Management AG, Winterthur (CH)

(72) Inventor: Nicolas Amalric, Versailles (FR)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 18/660,369

(22) Filed: May 10, 2024

(30) Foreign Application Priority Data

May 30, 2023 (EP) ..... 23176048

(51) Int. Cl.

| | |
|---|---|
| ***F04D 29/42*** | (2006.01) |
| ***F04D 1/00*** | (2006.01) |
| ***F04D 29/02*** | (2006.01) |
| ***F04D 29/62*** | (2006.01) |

(52) U.S. Cl.
CPC ..... *F04D 29/426* (2013.01); *F04D 1/00* (2013.01); *F04D 29/026* (2013.01); *F04D 29/4293* (2013.01); *F04D 29/628* (2013.01)

(58) Field of Classification Search
CPC .. F04D 29/426; F04D 29/4293; F04D 29/605; F04D 29/60; F04D 29/628
See application file for complete search history.

(56) References Cited

U.S. PATENT DOCUMENTS 1,471,559 A * 10/1923 Enauf ..... F04D 29/626 248/676
3,754,843 A * 8/1973 Dernedde ..... F16M 5/00 415/206
3,791,760 A * 2/1974 Lipe ..... F04D 29/605 415/206
3,891,345 A * 6/1975 Doolin ..... F04D 29/605 417/423.1
4,900,224 A * 2/1990 Timperi ..... F04D 29/605 248/637
6,152,719 A * 11/2000 Nelik ..... F04C 2/086 418/201.1

FOREIGN PATENT DOCUMENTS

CN 103133354 A 6/2013
DE 102012200948 A1 7/2013

OTHER PUBLICATIONS

European Search Report issued Nov. 17, 2023 in corresponding European Application No. 23176048.9.

* cited by examiner

*Primary Examiner* — Eldon T Brockman
(74) *Attorney, Agent, or Firm* — Global IP Counselors, LLP

(57) ABSTRACT

A centrifugal pump for conveying a fluid is proposed includes a pump housing and a bearing housing fixedly connected with the pump housing. The pump housing includes an inlet nozzle for receiving the fluid, a volute for accommodating an impeller, and an outlet nozzle for discharging the fluid. A shaft is arranged in the pump housing and rotates the impeller about an axial direction. The centrifugal pump is a foot mounted, horizontal overhung pump having two support legs fixedly connected to the volute of the pump housing, and mount the centrifugal pump to a base. A third support leg is fixedly connected to the inlet nozzle and is to be mounted to the base.

18 Claims, 1 Drawing Sheet

CENTRIFUGAL PUMP FOR CONVEYING A FLUID

CROSS-REFERENCE TO RELATED APPLICATION

This application claims priority to European Application No. 23176048.9, filed May 30, 2023, the contents of which are hereby incorporated by reference in its entirety.

BACKGROUND

Technical Field

The disclosure relates to a centrifugal pump for conveying a fluid.

Background Information

Conventional centrifugal pumps for conveying a fluid for example a liquid such as water, can be used in many different industries. Examples are the oil and gas industry, the power generation industry, the chemical industry, the water industry or the pulp and paper industry. Centrifugal pumps have at least one impeller and a shaft for rotating the impeller. The at least one impeller can be configured for example as a radial impeller or as an axial or semi-axial impeller or as a helicoaxial impeller. Furthermore, the impeller can be configured as an open impeller or as a closed impeller, where a shroud is provided on the impeller, said shroud at least partially covering the vanes of the impeller.

SUMMARY

A centrifugal pump can be designed as a single stage pump having only one impeller mounted to the shaft or as a multistage pump comprising a plurality of impellers, wherein the impellers are arranged one after another on the pump shaft.

In particular, the disclosure relates to a centrifugal pump which is configured as a foot mounted, horizontal overhung pump. Foot mounted—as opposed to centerline mounted-means that the pump comprises support legs, which are fixed to the bottom side of the pump housing and configured to be mounted to a base, such as a base plate. Horizontal means that the shaft for rotating the impeller(s) extends horizontally. i.e. perpendicular to the direction of gravity. Overhung means that the shaft with the impeller is only supported on one side of the impeller.

Thus, the disclosure relates for example to centrifugal pumps of the type OH1 according to the API 610 classification. OH1 is an overhung, flexibly coupled, horizontal, foot mounted centrifugal pump. Usually, OH1 pumps are configured as single stage pumps.

According to a known configuration the foot mounted, horizontal overhung pump comprises two support legs, which are fixedly connected to the bottom side of the volute of the pump housing and mounted to the base plate, so that the pump is fixedly connected to the base plate by means of the two support legs.

Amongst the numerous applications for which such centrifugal pumps are used is the use in nuclear power plants, for example as emergency pumps for sprinkling water on heated components to cool them in case of a failure. It goes without saying that for such applications very high safety standards have to be fulfilled to ensure a reliable operation of the pump even under difficult conditions, which can occur in an emergency e.g. because of a failure. For example, it can be required that these pumps can reliably be operated at ambient temperature of up to 100° C. or even more.

Usually, the centrifugal pump comprises a pump housing with an inlet nozzle, a volute and an outlet nozzle. The impeller of the pump is arranged in the volute and sucks the fluid through the inlet nozzle. The fluid is pressurized by the impeller and discharged through the outlet nozzle. The inlet nozzle is usually connected to an inlet piping through which the fluid, such as water, is guided to the inlet nozzle. The connection between the inlet piping and the inlet nozzle can be configured as a flange connection or as a weld connection, i.e. the inlet piping is welded to the inlet nozzle.

Usually, the inlet nozzle is exposed to loads, which are transferred from the inlet piping to the inlet nozzle. Such loads are for example caused by thermally induced dimension changes of the inlet piping. As an example, the centrifugal pump can be arranged in an environment, where the ambient temperature may strongly change, for example from approximately 10° C. or even lower to more than 100° C., e.g. up to 140° C. These changes in the ambient temperature cause thermal effect, such as thermal expansion of the inlet piping. Such thermal effects cause strong loads acting on the inlet nozzle, which is fixedly connected to the inlet piping.

These loads comprise both forces and torques acting on the inlet nozzle. The loads can generate a rocking or a tilting of the entire pump housing, which can lead to a shaft displacement or a misalignment of the shaft.

According to a known solution, e.g. for OH1 pumps or foot mounted, single stage overhung pumps, a bearing bracket is mounted to the bearing housing adjacent to the coupling, where the shaft is coupled to a drive unit. On the one side, the bearing bracket is fixedly connected to the bearing housing, on the other side the bearing bracket is fixedly mounted to the base plate on which the pump is mounted. Thus, the bearing bracket supports the bearing housing and therewith should at least reduce the tilting movement of the pump housing caused by loads acting on the inlet nozzle. This shall avoid a misalignment of the shaft. According to a known solution the bearing bracket is L-shaped, wherein the shorter limb of the L is mounted to the base plate and the longer limb of the L supports the bearing housing. This bearing bracket shall limit displacements of the end of the shaft, which is coupled to the drive unit.

The bearing bracket is a separate component, which is mounted to the bearing housing and the base plate during installation of the centrifugal pump. However, in particular at higher temperatures problems occur due to different thermal expansions of the pump housing and the bearing bracket. This different thermal expansion can cause torques acting on the pump housing and jeopardizing the alignment of the shaft. Removing or not mounting the bearing bracket has the disadvantage that a tilting of the pump housing around the two support legs may occur. This could cause larger displacements of the end of the shaft resulting in excessive loads in particular to the coupling between the pump and the drive unit. Furthermore, removing or not using the bearing bracket could result in stronger vibrations of the pump.

Starting from this state of the art it is therefore an object of the disclosure to propose a foot mounted horizontal overhung pump, which can withstand higher nozzle loads without a detrimental effect in particular regarding displacements of the end of the shaft.

The subject matter of the disclosure satisfying this object is characterized by the features disclosed herein.

Thus, according to the disclosure, a centrifugal pump for conveying a fluid is proposed, comprising a pump housing and a bearing housing fixedly connected with the pump housing, wherein the pump housing comprises an inlet nozzle for receiving the fluid, a volute for accommodating an impeller, and an outlet nozzle for discharging the fluid, wherein a shaft is arranged in the pump housing and configured for rotating the impeller about an axial direction, wherein the centrifugal pump is configured as a foot mounted, horizontal overhung pump having two support legs fixedly connected to the volute of the pump housing, and configured for mounting the centrifugal pump to a base. A third support leg is provided, wherein the third support leg is fixedly connected to the inlet nozzle and configured for being mounted to the base.

By providing the third support leg which is directly supporting the inlet nozzle of the pump housing, the loads acting on the inlet nozzle are directly transmitted from the inlet nozzle through the third support leg to the base. Thus, any negative impact of the loads acting on the inlet nozzle is at least considerably reduced, and loads are directly transmitted to the base and do no longer result in torques causing a tilting of the pump around the two support legs connected to the volute. This also at least remarkably reduces any misalignment of the shaft at the end of the shaft connected to the drive unit.

For the centrifugal pump according to the disclosure it is no longer necessary to provide a separate bearing bracket between the bearing housing and the base for supporting the bearing housing. Therefore, it is preferred that the centrifugal pump according to the disclosure is configured without such a bearing bracket.

It is preferred that the third support leg is integrally formed with the inlet nozzle. The third support leg includes the same material as the inlet nozzle. Thus, by integrally forming the third support leg with the inlet nozzle any detrimental effect resulting from different thermal expansions can be reliably prevented.

Even more preferred, the pump housing, the two support legs and the third support leg are integrally formed as one part. Thus, the entire pump housing including the inlet nozzle the volute and the outlet nozzle, as well as the two support legs at the volute and the third support leg are manufactured as a single part and preferably from the same material. This minimizes any negative impact resulting from different thermal expansions.

Furthermore, using a pump housing with three support legs integrally formed with the pump housing as a single part, is a more predictable configuration as compared to the configuration with the separate bearing bracket. Mounting the bearing bracket to the pump creates a kind of preload to the bearing housing, which is quite difficult to adjust. In a single part configuration of the pump housing and the three support legs, there is no need for a complicated adjustment. The three support legs are simply fixed to the base, e.g. a base plate.

Due to the third support leg provided at the inlet nozzle it is also possible to configure the centrifugal pump with a long inlet nozzle. For example, the centrifugal pump can be configured with an inlet nozzle, that has a length in the axial direction which is larger than the extension of the volute in the axial direction. Such long inlet nozzle do not cause any problems because the third support leg directly supports the inlet nozzle and transfers the loads acting on the inlet nozzle, e.g. loads caused by the inlet piping, to the base, on which the pump is mounted.

In particular for application, where high ambient temperature may occur, e.g. in nuclear power plants, it is a preferred measure that the bearing housing is made of aluminum. For example, in nuclear power plants, when the centrifugal pump is an emergency pump for sprinkling water on heated components to cool them in case of a failure, a cooling system or a cooling circuit for the centrifugal pump itself is quite often not allowed. Since aluminum has very good heat dissipation properties, aluminum is preferred as material for the bearing housing for such applications with potentially very high ambient temperatures.

The pump housing is made of stainless steel, for example. As an alternative the pump housing is made of cast iron. The three support legs can be made of stainless steel or of cast iron, for example.

In particular, in view of such applications, where the centrifugal pump may be exposed to high ambient temperatures, it is preferred, that the centrifugal pump is configured for an ambient temperature of at least 100° C.

As already mentioned, according to a preferred embodiment the centrifugal pump is configured for a nuclear power plant.

Further advantageous measures and embodiments of the disclosure will become apparent from the dependent claims.

BRIEF DESCRIPTION OF THE DRAWINGS

The disclosure will be explained in more detail hereinafter with reference to the drawings.

DETAILED DESCRIPTION

Figure 1:
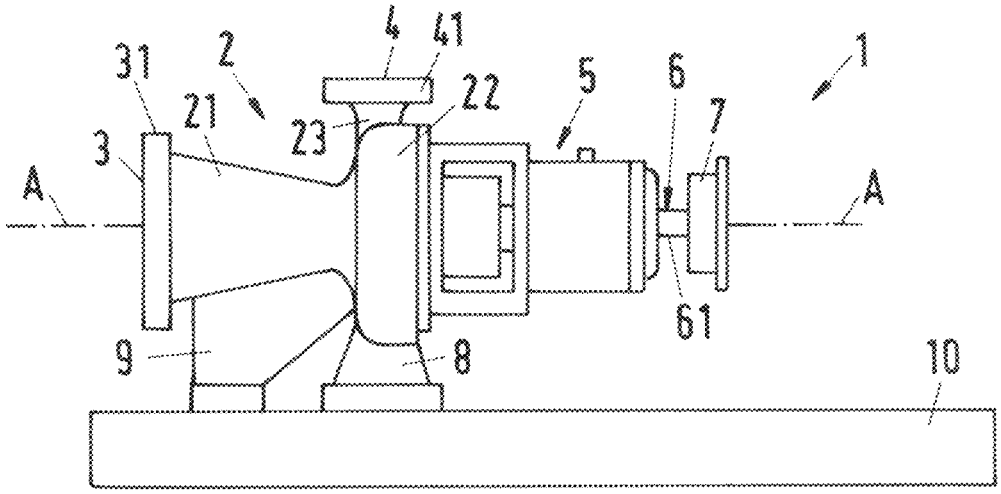
FIG. 1 illustrates a schematic side view of an embodiment of a centrifugal pump according to the disclosure.

FIG. 1 illustrates a schematic side view of an embodiment of a centrifugal pump according to the disclosure, which is designated in its entity with reference numeral 1. The pump 1 is designed as a centrifugal pump for conveying a fluid, for example a liquid such as water.

The centrifugal pump 1 comprises a pump housing 2 and a bearing housing 5 fixedly connected with the pump housing 2, for example by means of screws or bolts and nuts. The pump housing 2 comprises an inlet nozzle 21, a volute 22 and an outlet nozzle 23. The inlet nozzle 21 comprises a pump inlet 3 for receiving the fluid to be conveyed, and the outlet nozzle 23 comprises a pump outlet 4 for discharging the fluid. The volute 22 accommodates an impeller, which is not visible in FIG. 1. Preferably the inlet nozzle 21, the volute 22 and the outlet nozzle 23 are integrally formed as one part. i.e. the pump housing 2 consists of a single part.

However, it is also possible to configure the inlet nozzle 21 and/or the outlet nozzle 23 as a separate part, i.e. separate from the volute 22. The separate inlet nozzle 21 and/or the separate outlet nozzle 23 are then sealingly connected and fixed to the volute 22.

The pump inlet 3 of the inlet nozzle 21 can be connected to an inlet piping (not shown) for guiding the fluid to the pump inlet 3 of the inlet nozzle 21. The inlet piping can be connected to the inlet nozzle 21 by means of an inlet flange 31. Alternatively, the inlet piping can be welded to the inlet nozzle 21.

The pump outlet 4 of the outlet nozzle 23 can be connected to an outlet piping (not shown) for discharging the fluid from the pump outlet 4 of the outlet nozzle 23. The outlet piping can be connected to the outlet nozzle 23 by means of an outlet flange 41. Alternatively, the outlet piping can be welded to the outlet nozzle 23.

The inlet nozzle 21 shown in FIG. 1 is configured as a long inlet nozzle 21. Within the framework of this application the term long inlet nozzle designates an inlet nozzle 21 having a length in the axial direction A which is larger than the extension of the volute 22 in the axial direction A. In other embodiments the inlet nozzle 21 is configured shorter, e.g. such that the inlet nozzle 21 has a length in the axial direction A which is shorter than the extension of the volute 22 in the axial direction A.

The impeller arranged in the volute 22 is fixedly connected in a torque proof manner to a shaft 6 for rotating the impeller about an axial direction A. The impeller is preferably configured as a radial impeller for redirecting the fluid from the axial direction in a radial direction. The fluid entering the centrifugal pump through the inlet nozzle 21 flows in axial direction A towards the impeller rotating in the volute 22. The impeller acts on the fluid and pressurizes the fluid. The fluid leaves the impeller in a direction generally perpendicular to the axial direction.

The centrifugal pump 1 is configured as a single stage pump, i.e. the centrifugal pump 1 has only one impeller. In other embodiments the centrifugal pump 1 can be configured as a multistage pump having two or more impellers mounted in series on the shaft 6.

Furthermore, the centrifugal pump 1 is configured as a horizontal overhung pump 1. Horizontal means that the shaft 6 is extending in the horizontal direction, i.e. perpendicular to the direction of gravity. Thus, the axial direction A is perpendicular to the direction of gravity. Overhung means that the impeller is mounted at one end of the shaft 6. With respect to the axial direction A the shaft 6 is only supported on one side of the impeller, namely the right side according to the representation in FIG. 1.

The shaft 6 is supported both with respect to the axial direction A as well as with respect to the radial directions perpendicular to the axial direction A by one or more bearings which are arranged in the bearing housing 5. The shaft 6 extends from the impeller through the bearing housing 5 to a drive end 61 of the shaft 6, which is connected by means of a coupling 7 to a drive unit (not shown). The drive unit comprises, for example, an electric motor configured to rotate the shaft 6 and the impeller fixed to the shaft 6 about the axial direction A.

The centrifugal pump 1 is configured as a foot mounted centrifugal pump 1 and comprises two support legs 8 (first and second support legs) which are fixedly connected to the volute 22. Thus, the centrifugal pump 1 is supported considerably below the centerline of the centrifugal pump. Each support leg 8 extends from the volute 22 of the pump housing 2 essentially perpendicular to the axial direction A and downwardly (according to the representation in FIG. 1) The two support legs 8 are configured for mounting the centrifugal pump 1 to a base, for example a base plate 10. The support legs 8 are fixedly connected to the base plate 10, for example by screws or nuts and bolts (not shown).

The foot mounted horizontal centrifugal pump 1 is for example configured as an OH1 type pump according to the API 610 classification.

According to the disclosure, a third support leg 9 is provided, which is fixedly connected to the inlet nozzle 21 and configured for being mounted to the base, here the base plate 10. Thus, the third support leg 9 directly supports the inlet nozzle 21.

Figure 2:
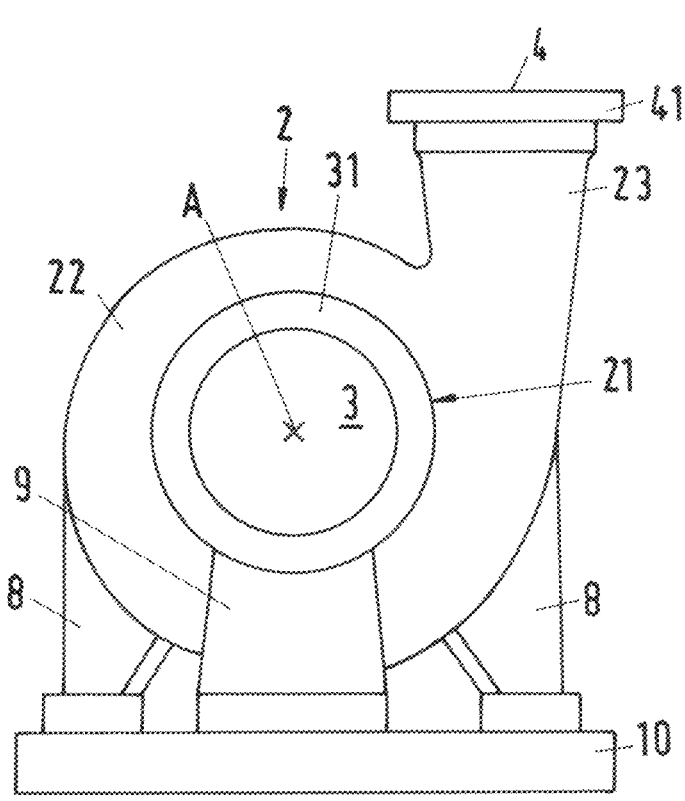
FIG. 2 illustrates a schematic front view of the embodiment from FIG. 1.

In the embodiment of the centrifugal pump 1 illustrated in FIG. 1 and FIG. 2, the third support leg 9 extends from the underside of the inlet nozzle 21 to the base plate 10. The underside of the inlet nozzle 21 is the side facing the base plate 10. The third support leg 9 is fixedly connected to the base plate 10, for example by screws or nuts and bolts (not shown).

The third support leg 9 transfers the loads acting on the inlet nozzle 21 and generated for example by the inlet piping, e.g. by thermal expansions of the inlet piping, directly to the base plate 10, so that a rocking or tilting movement of the pump housing 2 about the two support legs 8 is reliably prevented. The third support leg 9 beneath the inlet nozzle 21 therewith improves the alignment of the shaft 6, in particular of the drive end 61 of the shaft 6. Furthermore, contact between the rotating impeller and a stationary part, for example a wear ring, is reliably prevented.

According to a preferred embodiment, the third support leg 9 is made from the same material as the inlet nozzle 21 and integrally formed with the inlet nozzle 21 to form a single part. By this measure a negative impact caused by different thermal expansions can be avoided or at least considerably reduced.

Because of the third support leg 9 below the inlet nozzle 21 it is no longer necessary to provide a bearing bracket supporting the bearing housing 5 as it is a known measure from the prior art. Therefore, the centrifugal pump 1 preferably has no such bearing bracket.

In some embodiments the pump housing 2 the two support legs 8 and the third support leg 9 are integrally formed as one part and from the same material.

The pump housing 2 and/or the two support legs 8 and/or the third support leg 9 can be made of stainless steel or cast iron, for example In particular, for applications with potentially high ambient temperatures outside the centrifugal pump 1, the bearing housing 5 can be made from aluminum.

What is claimed is:

1. A centrifugal pump for conveying a fluid, comprising:

a pump housing;

a bearing housing fixedly connected with the pump housing, the pump housing comprising an inlet nozzle to receive the fluid, a volute to accommodate an impeller, and an outlet nozzle to discharge the fluid; and a shaft arranged in the pump housing and configured to rotate the impeller about an axial direction, the centrifugal pump configured as a foot mounted, horizontal overhung pump having first, second and third support legs, the first and second support legs fixedly connected to the volute of the pump housing, and configured to mount the centrifugal pump to a base, the third support leg fixedly connected to the inlet nozzle and configured to be mounted to the base.

2. The centrifugal pump in accordance with claim 1, wherein the third support leg is formed integrally with the inlet nozzle.

3. The centrifugal pump in accordance with claim 2, wherein the pump housing, the first and second support legs and the third support leg are integrally formed as one part.

4. The centrifugal pump in accordance with claim 2, wherein the inlet nozzle has a length in the axial direction which is larger than an extension of the volute in the axial direction.

5. The centrifugal pump according to claim 2, wherein the centrifugal pump is configured for an ambient temperature of at least 100° C.

6. The centrifugal pump according to claim 2, wherein the centrifugal pump is configured for a nuclear power plant.

7. The centrifugal pump in accordance with claim 1, wherein the pump housing, the first and second support legs and the third support leg are integrally formed as one part.

8. The centrifugal pump in accordance with claim 7, wherein the inlet nozzle has a length in the axial direction which is larger than an extension of the volute in the axial direction.

9. The centrifugal pump according to claim 7, wherein the centrifugal pump is configured for an ambient temperature of at least 100° C.

10. The centrifugal pump according to claim 7, wherein the centrifugal pump is configured for a nuclear power plant.

11. The centrifugal pump in accordance with claim 1, wherein the inlet nozzle has a length in the axial direction which is larger than an extension of the volute in the axial direction.

12. The centrifugal pump according to claim 11, wherein the centrifugal pump is configured for an ambient temperature of at least 100° C.

13. The centrifugal pump according to claim 11, wherein the centrifugal pump is configured for a nuclear power plant.

14. The centrifugal pump according to claim 1, wherein the pump housing is stainless steel.

15. The centrifugal pump according to claim 1, wherein the bearing housing is aluminum.

16. The centrifugal pump according to claim 1, wherein the centrifugal pump is configured for an ambient temperature of at least 100° C.

17. The centrifugal pump according to claim 16, wherein the centrifugal pump is configured for a nuclear power plant.

18. The centrifugal pump according to claim 1, wherein the centrifugal pump is configured for a nuclear power plant.

* * * * *